US005524317A

United States Patent [19]

Nagahama et al.

[11] Patent Number: 5,524,317

[45] Date of Patent: Jun. 11, 1996

[54] SEPARATE MAT FOR RENT

[75] Inventors: Yuji Nagahama; Junji Taguchi, both of Suita-fu, Japan

[73] Assignee: Duskin Co., Ltd., Osaka, Japan

[21] Appl. No.: 340,686

[22] Filed: Nov. 16, 1994

[30] Foreign Application Priority Data

Nov. 17, 1993 [JP] Japan ..... 5-061952

[51] Int. Cl.[6] ..... A47L 23/22

[52] U.S. Cl. ..... 15/217; 15/215; 52/177; 52/DIG. 4; 428/95

[58] Field of Search ..... 15/215–217; 428/95; 52/177, 179, DIG. 4; 296/97.23

[56] References Cited

U.S. PATENT DOCUMENTS 4,397,900 8/1983 Higgins ..... 428/95

FOREIGN PATENT DOCUMENTS 4234792 5/1993 Germany ..... 52/DIG. 4

54-28413 3/1979 Japan ..... 52/DIG. 4

1573492 8/1980 United Kingdom ..... 52/DIG. 4

*Primary Examiner*—Mark Spisich

*Attorney, Agent, or Firm*—Robbins, Berliner & Carson

[57] ABSTRACT

A separate mat for rent comprising a mat body made up of a mat portion having mat piles implanted on the front surface of a base fabric and an elastomer backing blended with a magnetic powder on the back surface, and a thick frame-like-peripheral portion of an elastomer; and a base which supports the mat body and has a magnet rubber spread on a support surface. In the mat body, the back surface of the outer periphery of the mat portion and the upper surface of the peripheral frame of the mat are superposed one upon the other and joined together as a unitary structure. The base rubber is inserted in the back side of the mat body. Therefore, no step is formed between the mat body and the base yet the two are adhered very strongly. Besides, no wrinkles develop on the mat surface and homogeneous adhesion is accomplished. The mat is further excellent in fixing performance and stability, and can be easily attached or detached, and is very light in weight compared with the mats of the unitary structure.

6 Claims, 1 Drawing Sheet

SEPARATE MAT FOR RENT

BACKGROUND OF THE INVENTION

1. Field of the Invention

The present invention relates to a separate mat for rent. More specifically, the invention relates to a separate mat for rent which is relatively light in weight, enables a mat body and a base to be separated from each other and detachably attached together, and permits the mat body and the base to be intimately adhered together during the use, offering excellently fixed performance, stability during the use and safety.

2. Description of the Prior Art

Dust-control mats that are used being laid in porches and entrances of shops, offices and general houses can be classified into two types, i.e., separate mats and unitary mats.

These mats have generally been used on a rent basis; i.e., the mats are rented to the customers for a predetermined period of time, and are then recovered, washed, regenerated, and are rented again to the customers.

Among these mats, the separate mat has a base that serves as an underlayer and a mat body that can be mechanically separated from each other. In a rental service business, the mat bodies only are removed, recovered and are delivered. Moreover, the mat bodies only are washed and regenerated.

In the case of the unitary mats, the base that serves as an underlayer and the mat body have been constructed as a unitary structure. In the rental service business, therefore, the whole mat in which the base and the mat body are constructed as a unitary structure must be recovered and delivered. Moreover, the unitary mat as a whole must be washed and regenerated.

In the case of the separate mat for rent, the base made of a rubber or the like can be used semipermanently once it is laid. Therefore, the mat body only needs be produced making it possible to offer many kinds of mats at a reduced cost so that different kinds of the mats can be used.

Compared with the unitary mats, furthermore, the mat body only needs be recovered, carried, transited and stored presenting such advantages that the mats are light in weight and are not bulky, enabling the cost for distribution to be decreased, reducing the burden of washing, and allowing the mats to be washed and regenerated at a low cost.

The separate mat, however, requires some adhesion mechanism between the mat and the base made of a rubber or the like. If the adhesion mechanism does not favorably work, the adhesive force Is often lost between the mat and the rubber base arousing such inconvenience that the position is deviated and the mat is turned up deteriorating the appearance. Moreover, safety is lost for the persons who walk on it and function of wiping the shoes is lost.

Furthermore, the mat body and the rubber base must be set intimately and flatly so that the operation efficiency is at the time of the mounting operation. In an ordinary separate mat In which the mat body is placed on a framed base rubber, furthermore, the edge of the base frame is higher than the floor surface against which a pedestrian may stumble or which hinders the door from being opened and closed.

As for the adhesion mechanism between the mat body and the base in a separate mat, a physical and partial adhesion mechanism based upon a face fastener has generally been used as disclosed in, for example, Japanese Patent Publication No. 7450/1984.

If described in detail, a female portion (loop portion) of the face fastener is installed on the back surface of the base fabric of the mat body and a male portion (hooked or cut portion) of the face fastener are installed on the upper surface of the base.

Moreover, several mechanisms have been proposed already in regard to adhering the mat body and the base together by using the magnetic force of a magnetic material as disclosed in, for example, Japanese Laid-Open Patent Publication No. 28413/79, Japanese Laid-Open Utility Model Publication No. 16976/1984, Japanese Laid-Open Utility Model Publication No. 95079/1985 and Japanese Laid-Open Patent Publication No. 118774/1985.

In the separate mat, the following methods can be contrived in regard to detachably adhering the mat body and the base together.

Physical adhesion:

1. Adhesion using a face fastener.
2. Adhesion based on a combination of rugged surfaces.
3. Adhesion using a mechanical fastening device.
4. Adhesion using a magnetic material.
5. Chemical adhesion.

With the adhesion system using the face fastener, however, the adhesion strength of the face fastener inevitably decreases after the mat for dust control is washed and regenerated repetitively.

The face fastener, in many cases, is installed on portions of the mat surface, i.e., installed at four corners and at the centers of the sides in general.

When the face fastener is installed partly, e.g., on four corners, however, wrinkles develop when non-adhered portions of the sides are trod by the shoes arousing a problem in regard to safety (walking) and deteriorating the appearance. When the face fastener is used along the whole sides, the mat becomes undulated after it is washed repetitively due to a difference in the shrinkage between the mat cloth and the fastener portion.

When the mat as a whole is viewed, furthermore, the adhesion portion becomes thicker by the thicknesses of the male portion and the female portion of the face fastener, deteriorating the appearance and causing a problem in that the door cannot be smoothly opened or closed.

From the standpoint of manufacturing steps, the face fastener must be stitched after the fabric is prepared, which causes the rising of the manufacturing cost.

In the case of the adhesion using rugged surfaces and a mechanical fastening device, a shape must be formed on the back surface of the fabric which inevitably results in an increase in cost and weight. Moreover, adhesive force is difficult to obtain in the vertical direction, rugged portions themselves are worn out through the repetitive washing of the fabric, and the fabric on the surface is deteriorated (worn out) causing the life of the fabric to be shortened.

In the case of the adhesion using the adhesive material, the adhesive force decreases upon the infiltration of rain, sand and the like, making it difficult to stably maintain the adhesive force under all whether conditions.

In contrast with the above-mentioned adhesion methods, the adhesion utilizing the magnetic material maintains the adhesive force favorably and stably against changes in an external environment, varies little even after many times of washing, and stably maintains the adhesive force as a whole.

With the adhesion system using the magnetic material, however, the base that serves as an underlayer and the mat body must be strongly and evenly adhered together to such an extent that they endure the use maintaining a sufficiently large adhesive force. For this purpose, the adhesion surface must be smooth and the gap must be as small as possible between the adhesion surfaces. In the case of a mat on which pile yarns are implanted, however, it is not possible to completely avoid the ruggedness caused by the stitching of pile yarns on the backing layer on the back surface of the fabric. When an ordinary magnetic material is used, therefore, it is in many cases difficult to establish a sufficiently strongly and uniformly fixed state. The above-mentioned problem can be solved to some extent by reinforcing the adhesive force by using a magnetic material having stronger magnetic force. In the mats for rent, however, it is difficult to employ a magnetic material having a particularly strong magnetic force from the standpoint of cost and weight. Besides, when the mat is adhered using a magnetic material having a particularly strong magnetic force, it becomes difficult to maintain homogeneity of adhesion. Moreover, once the mat is fixed in a wrinkled state, it becomes difficult to correct the wrinkles.

Because of such circumstances, the magnetic force has not yet been practically utilized for fixing the mat to the base though many proposals have been made in regard to utilizing the magnetic force.

SUMMARY OF THE INVENTION

The object of the present invention therefore is to provide a separate mat for rent which is free from the above-mentioned problems inherent in the prior magnetically adhered separate mat, which, at the time of rental service, enables the mat to be easily removed, to be easily washed, and which is light in weight compared with the unitary mat, exhibits a strong adhesive force (between the mat fabric and the rubber base), and maintains stable adhesive force against a change in the environment (rain, sunlight, adhesion of dust at the customer's place).

According to the present invention, there is provided a separate mat for rent comprising a mat body having a base fabric, mat piles implanted on the base fabric and an elastomer backing applied to the back surface of the base fabric, and a base having a flat surface for supporting the mat, wherein the backing of the mat body is formed of an elastomer coating blended with a magnetic powder, a frame-like thick elastomer backing sheet is applied to the periphery on the back surface of the mat body so as to protrude inwardly and outwardly beyond the edges of the base fabric, at least the flat surface of the base for-supporting the mat is formed of a magnet rubber sheet, and the edges along the periphery of the base are on the inside of the outer peripheral edges of the elastomer backing sheet.

DETAILED DESCRIPTION OF THE INVENTION

The separate mat of the present invention comprises a mat body in which an elastomer backing is applied to the back surface of a base fabric on which mat piles are implanted, and a base rubber having a flat surface for supporting the mat. Here, a first structural feature resides in that an elastomer coating blended with a magnetic powder is applied to the backing on the back surface of the mat body, and at least a flat surface of the base for supporting the mat is formed of a magnet rubber sheet.

Figure 2:
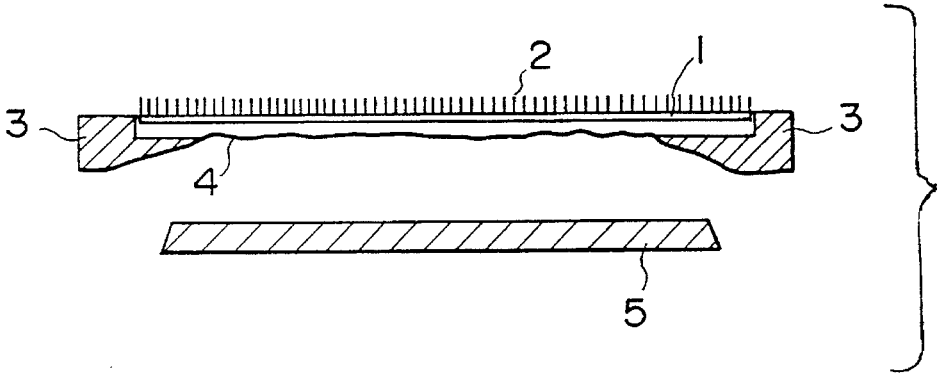
FIG. 2 is a schematic sectional view illustrating the structure of the separate mat for rent according to the present invention.
Figure 3:
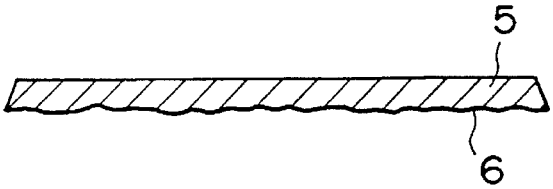
FIG. 3 is a diagram which schematically illustrates a base for the mat according to another embodiment of the present invention.

A second structural feature of the invention resides in the mat body in which, as will be obvious with reference to FIG. 2, the outer circumferential side portion is formed of a thick elastomer backing sheet in the form of a frame, a mat pile-implanted fabric applied with an elastomer backing is extended over the whole back surface of the mat body from slightly inside of the outer peripheral edge on the upper surface of the frame-like sheet, the overlapping portions of the upper surface of the frame-like sheet and the back surface of the base fabric are joined together as a unitary structure, the mat body has a backing rubber surface of a rugged form due to pile back stitching on the lower surface thereof extending over the whole back surface from the inner edge along the peripheral side portions of the frame-like thick elastomer, the peripheral end of the rubber base is located nearly at an intermediate position on the lower surface of the frame-like thick elastomer portion that constitutes the outer peripheral side portions, and the frame-like thick elastomer portion has such a width and a shape that its lower surface covers the upper peripheral ends of the rubber base.

The separate mat having the above-mentioned two features of the present invention utilizes the magnetic force for adhering the mat body and the base rubber together. Therefore, the adhesive force is stably obtained from the initial stage of adhesion until the mat body is peeled off. The adhesion maintains good adhesive force even against a change in an external environment, changes little with the passage of time even after washing many times and maintains a stable adhesive force as a whole.

In the separate mat of the present invention, the flat surface of the base for supporting the mat is formed of a magnet rubber sheet and the backing portion of the mat body is formed of an elastomer blended with a magnetic powder. This is because the base which is formed of the magnet rubber sheet and is heavy and used in the fixed state, and the mat body is made as light in weight as possible so that it can be removed and carried for washing and regeneration. Furthermore, the backing portion of the mat body which is simply blended with the magnetic powder helps avoid such an inconvenience that the mat bodies are adhered together by the magnetic force at the time of washing and regenerating the mat bodies.

In the separate mat of the present invention, furthermore, the mat body is formed in a particular shape as described above, the elastomer backing layer blended with a magnetic powder is formed on the flat surface on the inside of the thick outer peripheral portion on the back surface of the mat body, and the magnetized base rubber is installed at a position facing the elastomer backing layer.

Accordingly, the magnetic material-containing backing surface of the mat body and the magnet rubber sheet surface of the base rubber are set as opposing flat surfaces maintaining a suitable positional relationship, and are adhered together strongly, homogeneously and intimately.

Since the adhesion due to the magnetic force is homogeneous between the two flat surfaces, ruggedness such as wrinkles are prevented from developing on the surface of the fabric on the front side of the mat body.

Usually, the elastomer backing surface on the back surface of the fabric cannot be formed in a completely smooth surface and contains undulatory ruggedness caused by stitching. In the case of the mat of the present invention in which the mat body is subjected to a heat-working under the application of pressure in a step of joining the outer peripheral portion to the mat body, however, the undulatory ruggedness can be nearly flattened, and the contact area can be strikingly increased between the back surface of the mat body and the adhesion surface of the base sheet, making it possible to obtain a sufficiently large magnetic adhesive force between the mat and the base. Moreover, the outer peripheral portion of the mat body is formed of a thick sheet in the form of a frame. In a state in which the mat body is placed on the base, the fabric surface receives such a tension that the fabric surface is pulled toward the outer periphery at all times due to the weight of the thick sheet forming the periphery of the mat body. Due to the action of this tension, the backing elastomer surface on the back surface of the fabric pushes the upper surface of the base rubber, i.e., pushes the magnet rubber surface which supports the mat.

In a state in which the mat body is placed on the base rubber, therefore, stitches on the backing surface of the mat body are crashed to establish a state which is close to a flat surface, whereby the contact area increases relative to the base rubber, the adhesive force increases, and a strongly adhered state is obtained.

The mat is subject to be mechanically damaged most at the edges thereof while it is being used, i.e., the edges are subject to be broken. However, the mat of the present invention has the outer peripheral edges that are formed of a thick frame-like sheet having an increased strength. Therefore, the separate mat of the present invention is little damaged at the edges during use, which is one of the advantages of the invention.

There has been proposed a separate mat of a form in which a mat portion is superposed on the base rubber or the like. In such a separate mat, however, the fiber portion shrinks after the mat is used repetitively resulting in the formation of wave-like flares along the outer peripheral portion of the mat. When the mat is placed on the base rubber, a pedestrian may stumble against a gap between the base rubber and the mat, or the mat tends to be turned up from the base.

According to the mat of the present invention, the base is installed having a size smaller than the outer peripheral portion of the mat body, and has the outer side of a structure that does not almost develop a step between the mat body and the base. Moreover, since a thick rubber layer is provided along the outer periphery of the mat body, the periphery is heavier than the central portion, and the ends of the mat are not turned up despite people walk on the mat.

Even when the separate mat is repetitively used on a rent basis, undulatory flare does not develop along the outer periphery of the mat, and the pedestrians do not stumble against it.

EXAMPLE

The invention will now be described with reference to the accompanying drawings.

Figure 1:
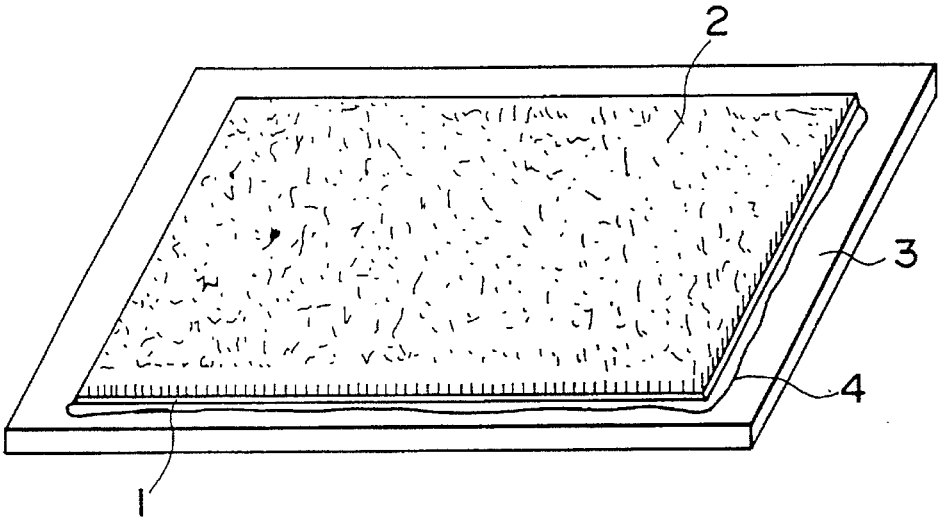
FIG. 1 is a perspective view illustrating a separate mat for rent according to the present invention.

FIG. 1 is a perspective view illustrating the appearance of a separate mat for rent according to the present invention, and FIG. 2 is a sectional view for schematically illustrating the structure of the mat and wherein pile yarns 2 are implanted on the front surface of a base fabric 1 that constitutes the mat body, and an elastomer 4 blended with a magnetic powder is backed to the back surface thereof.

Moreover, a thick frame 3 of an elastomer backing sheet is provided along the outer peripheral edge of the mat body, the base fabric 1 is superposed on the elastomer sheet 3 near the peripheral edge thereof, and the backing elastomer of the base fabric 1 and the upper surface of the elastomer sheet frame 3 are joined together at the superposed portions, so that the mat and the frame are constructed as a unitary structure.

As will be obvious from FIG. 2 the back surface of the thus formed mat body is flat and is nearly smooth and in which will be inserted a base rubber 5 whose support surface is formed of a magnet rubber sheet. The base rubber 5 is formed of a magnet rubber having a smooth upper surface, has a width that can be just inserted within the back surface of the mat body, and has a thickness that does not cause the rubber sheet along the outer periphery of the mat body to float.

The separate mat for rent of the present invention is used by, first, placing the base rubber 5 at a predetermined placing position and, then, placing the mat body thereon in a manner that the base rubber is just covered.

Though the mat body used in the present invention is constructed as described above, it should be noted that there is no particular limitation on the planar shape, the length of the mat pile, the shape of the surface portion or the color. The mat can be realized in any planar shape and in any pile shape that are usually employed for the mats.

The base fabric constituting the mat body may be any one of a woven fabric, a nonwoven fabric, a knitted fabric, a netting and a plastic net, and the fiber that constitutes the base fabric may be any synthetic fiber such as a polyester fiber, a polyamide fiber, an acrylic fiber, or an ultra-high molecular weight polyolefin fiber. Most desirably, however, the fiber constituting the base fabric should be a thermoplastic copolyester comprising chiefly a high molecular thermoplastic polyester and, particularly polyethylene terephthalate or ethylene terephthalate.

In the case of the woven fabric, there is no particular limitation on the woven structure and a plain weaving will suffice for the need. As required, however, the fabric may be twill-woven or may be woven in any other modified form. The nonwoven fabric may be a spun-bonded nonwoven fabric, a melt-blown nonwoven fabric or a combination thereof. In general, the weight of the base fabric should desirably lie within a range of from 50 to 500 g/m$^2$ though it may vary depending upon the weight of the mat and the like.

Pile yarns to be studded on the base fabric will be spun yarns or multi-filament yarns consisting of one or two or more kinds of a cotton fiber, a rayon fiber, a polyvinyl alcohol fiber, an acrylic fiber, a nylon fiber and any other synthetic fiber. The pile yarns can be studded by any known method such as tufting, sewing, embroidering, hooking or the like method. The pile length to be studded should usually be from 3 to 20 mm, and the kind of the pile may be a cut pile or a loop pile which may be crimped or uncrimped. Moreover, the pile length may be the same or different and may, for example, be high-cut/low-loop or the like. The size of the fiber can be greatly changed over a range of from 0.05 to 1300 denier. The piles may be implanted under known conditions, and the gauge should be from 2/inch to 20/inch, and the stitch should be from 2/inch to 20/inch.

Examples of the elastomer that serves as the backing include a nitrile-butadiene rubber (NBR), a styrene-butadiene rubber (SBR), a chloroprene rubber (CR), polybutadiene (BR), polyisoprene (IIB), a butyl rubber, a natural rubber, an ethylene-propylene rubber (EPR), an ethylene-propylene-diene rubber (EPDM), polyurethane, polyethylene chloride, polypropylene chloride, a soft vinyl chloride resin, and the like. The nitrile-butadiene rubber (NBR) is preferred from the standpoint of resistance against oils and weatherability. These elastomers are used in the form of a latex or a plastisol to form the backing.

Examples of the magnetic powder to be blended during the backing include an iron powder, an iron alloy powder, tri-iron tetroxide (magnetite) and ferrite. As the ferrite, there can be used ferrite particles of a composition consisting of one or two or more of zinc iron oxide, yttrium iron oxide, cadmium iron oxide, gadolinium iron oxide, lead iron oxide, nickel iron oxide, neodymium iron oxide, barium iron oxide, magnesium iron oxide, manganese iron oxide and lanthanum iron oxide. The magnetic powder should have a grain size of usually from 0.1 to 10 μm which is suited for forming the backing. The magnetic powder should be blended in an amount of from 20 to 1300 parts by weight and, particularly, from 50 to 800 parts by weight per 100 parts by weight of the elastomer from the standpoint of magnetic adhesive force and the durability of backing. Desirably, the backing elastomer should be blended with a high molecular plasticizer to further improve softness of the elastomer and to reinforce the adhesive force to the base rubber by magnetic force.

Examples of the high molecular plasticizer suited for the above object include polyester plasticizers such as a poly(diethylene glycol terpene maleic anhydride addition product) ester, poly(propylene glycol adipate) ester, poly(1,3-butanediol, adipate) ester, poly(propylene glycol sebacate) ester, poly(1,3-butanediol sebacate) ester, poly(propylene glycol phthalate) ester, poly(1,3-butanediol phthalate) ester, poly(ethylene glycol adipate) ester, poly(1,6-hexanediol adipate) ester, acetylated poly(butanediol adipate) ester <butanediol is of the 1,3-type or of the 1,4-type>, or those of the liquid rubber diene type of polybutadiene, polychloroprene, isoprene, acrylonitrile-butadiene-1,3-pentadiene, or those of the polysulfide rubber type, urethane type or silicone type.

It is desired that the high-molecular plasticizer usually has an average molecular weight of from 250 to 300,000 and, particularly, from 1000 to 100,000.

The high molecular plasticizer is blended in such an amount that a predetermined surface adhesive force is obtained. In general, the high molecular plasticizer should be blended in an amount of from 1 to 100 parts,by weight and, particularly, from 2 to 50 parts by weight per 100 parts by weight of the elastomer. When the amount is smaller than the above range, the auxiliary action is not fully exhibited to assist the surface adhesive force and when the amount exceeds the above range, the rubber itself tends to become too soft.

In addition to the above-mentioned blend, the elastomer for backing may be further blended with known blending agents such as a vulcanizing agent the sulfur type or organic type, a vulcanization promoting agent, a softening agent, an anti-aging agent, a filler, a dispersing agent, a plasticizer and a coloring agent in amounts that have been known.

It is desired that the elastomer composition blended with the above-mentioned components is applied in the form of a latex or a plastisol onto the nonpiled surface of the mat implanted with piles, and the backing layer should be applied in an amount of from 100 to 1500 g/m$^2$ and, particularly, from 200 to 1000 g/m$^2$ reckoned as a solid component.

The pile yarns for dust-control mat adsorbs and holds the dust adhered to the bottoms of the shoes upon rubbing the bottoms of the shoes. In order to further enhance the action for adsorbing and holding the dust by the pile yarns, the pile yarns may be applied with or impregnated with a dust-adsorbing liquid. Examples of the dust-adsorbing liquid include mineral oils, synthetic oils or vegetable oils such as a fluid paraffin, a spindle oil, an alkylbenzene oil, a diester oil and a castor oil, as well as aqueous dust-adsorbing agents disclosed in Japanese Patent Publications Nos. 10194/1978 and 37471/1978.

The frame 3 of the elastomer sheet forming the peripheral edges of the mat body is joined to the backing layer as a unitary structure. Therefore, the, elastomer sheet frame 3 must be favorably joined to the backing elastomer layer upon vulcanization and must exhibit good affinity thereto. Usually, the elastomer sheet frame 3 is made of the same material as the one used for the backing layer 4 of the base fabric.

The thickness of the elastomer frame 3 is determined in relation to the reinforcing effect, thickness (height) of the base rubber and the like. As expressed by the weight to surface ratio, however, the thickness of the elastomer frame 3 should generally be from 10 to 2000 g/m$^2$ and, particularly, from 100 to 700 g/m$^2$.

To prepare the mat body of the present invention, the elastomer composition is applied as backing to the back surface of the pile-implanted base fabric and, at the same time, the thick peripheral sheet frame is formed of the same latex elastomer in the form of a unitary structure by vulcanization and press. Or, the backing of the base fabric and the frame sheet are separately formed and then may be joined together.

The base sheet used in the present invention has a flat surface for supporting the mat that is at least formed of a magnet rubber sheet. The magnet rubber sheet is obtained by dispersing magnetic particles, i.e., by dispersing magnetized ferromagnetic particles in the cured elastomer. The magnetic rubber sheet is obtained by blending the elastomer with a ferromagnetic powder together, as required, with other blending agents, and kneading the blend followed by vulcanization and magnetization.

As the elastomer, there can be used the elastomer mentioned in connection with the backing of the mat body and, particularly, NBR. As the ferromagnetic material, ordinarily used powders can be used. Specific examples include a powder for ferrite magnet, cobalt, aluni or alunico, rare earth cobalt, soft ferrite powder and permalloy powder. As the ferrite, there can be used those mentioned in connection with the elastomer backing. Among them, barium iron oxide BaO. $6Fe_2O_3$, magnesium iron oxide MgO. $nFe_2O_3$, strontium iron oxide SrO. $6Fe_2O_3$ and MnZn. $nFe_2O_3$ are widely used from the standpoint of magnetic property.

The ferromagnetic powder having either anisotropic property or isotropic property can be used. Here, the isotropic magnetic particles have nearly a spherical shape and exhibit excellent machinability though their magnetic property is not so strong. The anisotropic magnetic particles, on the other hand, have a large long diameter/short diameter ratio and have strong magnetic property though their machinability is poor. The ferromagnetic powder should have a grain size of usually from 0.1 to 10 μm. The ferromagnetic powder should be blended in an amount of from 50 to 1300 parts by weight and, preferably, from 50 to 800 parts by weight per 100 parts by weight of the rubber component.

It is desired that even the base rubber sheet is blended with a high molecular plasticizer. In this case, use is made of the same high molecular plasticizer as the one used for the elastomer backing. It is desired that the high molecular plasticizer is blended in an amount of from 1 to 100 parts by weight and, particularly, from 2 to 50 parts by weight per 100 parts by weight of the elastomer like the case of the elastomer backing. The elastomer for the magnetic rubber sheet may be blended with known blending agents such as a vulcanizing agent of the sulfur type or the organic type, a vulcanization promoting agent, a softening agent, an anti-aging agent, a filler, a dispersing agent, a plasticizer and a coloring agent in amounts that have been known.

The above rubber composition is kneaded by using rolls or a kneader, and is molded into a sheet or into any other form followed by vulcanization. The vulcanization should usually be carried out at a temperature of from 130° to 200 ° C. under a pressure of from 0.5 to 5 kg/cm$^2$. The thus formed rubber sheet is placed in an intense magnetic field to magnetize it. The magnetization will be carried out under known conditions, and the magnetizing force is usually (BH)max=maximum energy of from $0.1\times10^6$ to $2.0\times10^6$ [GOe].

In the present invention, it is desired that the base as a whole is made up of a magnetic rubber sheet from the standpoint of simplicity in the structure. The base, however, may have a laminated layer structure in which the flat surface for supporting the mat is made of the magnet rubber sheet and the bottom is made of an ordinary rubber sheet. Or, only those areas of the mat-supporting flat surface needed for the adhesion may be formed of the magnet rubber sheet.

Though there is no particular limitation, the base of the present invention should have a shape which can be fitted to space on the back surface of the mat body and should have a thickness (height) that does not cause the rubber sheet at the periphery of the mat to float.

For instance, if fine rugged patterns are formed on the back surface (grounding surface) of the base of the invention, frictional force increases relative to the grounding surface; i.e., the base is prevented from undesirably moving which contributes to stably fixing the mat.

Mentioned below are the results of comparison and evaluation of practicability of the mat (stability of mat, fixing performance, etc.) of when the separate mat (A) for rent of the present invention and conventional separate mats (B) and (C) for rent are used nearly under the same conditions and the results of comparison and evaluation of when the mats are packed as goods and are then unpacked to use them.

(Preparation of the separate mat (A) for rent of the invention.)

A nonwoven fabric (basis weight 150 g/cm$^2$) of webs of yarns of 100% of a polyester was used as a base fabric, BCF nylon filament yarns were used as pile yarns, pile yarns were tufted to the base fabric in a manner of eight stitches/inch and eight gauges/inch, and the ends of the piles were trimmed to a pile height of 10 mm to form a mat surface. An NBR latex (solid component, 46%) of the following composition was applied in an amount of 600 g/m$^2$ reckoned as a solid component onto the stitched surface of the base fabric (starting fabric) to which the piles are tufted, and was dried and vulcanized at 170° C. for 30 minutes to form a backing layer.

| NBR latex composition | |
|---|---|
| NBR latex (solid component, 46%) | 100 parts by weight (on the basis of solid components) |
| Barium ferrite | 400 parts by weight |
| Vulcanizing agent, vulcanization promoting agent, etc. | 10 parts by weight |

The starting fabric on which the backing layer has been formed was cut into a size of 750 mm×900 mm, an unvulcanized solid rubber was adhered thereto followed by vulcanization to form a frame-like thick portion on the starting fabric, thereby to prepare the body of mat (A) of the present invention.

The frame-like thick portion of the mat body was formed in a shape as shown in FIG. 2 (sectional view), the frame-like thick portion having a width of about 40 mm and a maximum thickness of about 30 mm at the outer peripheral edge of the frame.

The portions of the frame outwardly exceeding beyond the edges of the base fabric possessed a width of about 20 mm, and, hence, the junction portion to the backing at the back surface of the base cloth possessed a width of about 20 mm.

As the unvulcanized solid rubber, a vulcanizing agent-containing NBR was used and was adhered at 180° C. for 15 minutes under a pressing force of 5 kg/cm$^2$.

Next, the mat base was prepared as described below.

| | |
|---|---|
| Chlorinated polyethylene | 100 parts by weight |
| Polyester-type plasticizer | 50 parts by weight |
| Silica powder | 40 parts by weight |
| Barium ferrite particles | 400 parts by weight |

were kneaded to obtain a composition which was then molded into a sheet of 2 mm thick. The sheet was then magnetized using a predetermined magnetizing device and was cut into a size nearly the same as the size of the starting fabric of the mat body, thereby to prepare the base.

(Preparation of the separate mat (B) for rent of a Comparative Example.)

An NBR latex of the following composition (solid component, 46%) was applied in an amount of 600 g/cm$^2$reckoned as a solid component onto the same starting fabric forming a pile surface as the one used for the separate mat (A) (Example) of the present invention, and was dried and vulcanized to form a backing layer.

| | |
|---|---|
| NBR latex (solid component, 46%) | 100 parts by weight (on the basis of solid components) |
| Vulcanizing agent, vulcanization promoting agent, etc. | 10 parts by weight |
| Drying and vulcanizing condition | 170° C., 30 minutes |

The starting fabric was then cut into a size of 750 mm×900 mm, an unvulcanized solid rubber (NBR) was adhered under the same conditions and in the same shape as those of the case of the aforementioned separate mat body (A) (Example) followed by vulcanization to prepare a mat (B) of Comparative Example.

The base of the mat (B) was the same as the one used for the mat (A) (Example).

(Preparation of a separate mat (C) for rent of Comparative Example.)

The latex of the same composition as the one used for the mat (B) was applied to the same starting fabric as the one used for the mat (A) and was treated in the same manner as for the mat (B) to form a backing layer.

The starting fabric was cut into a size of 750 mm×900 mm. Then, four pieces of a face fastener (looped shape) each having a size of 100 mm×20 mm were prepared, and were stitched to four corners of the starting fabric on the side of the backing layer thereby to prepare a mat (C).

Then, a vulcanized rubber sheet of NBR (2 mm thick) was cut into the same shape and size of the mat body, and face fasteners (hooked shape) were adhered by an adhesion method to positions at four corners of the sheet corresponding to the positions where the above face fasteners are attached to the mat body, thereby to obtain a base of the mat (C).

(Evaluation and testing of practical performance.)

The above-mentioned three kinds of mats (A), (B) and (C) and the bases were laid at a place of 3000 passers-by a day for four days. Then, the mat bodies only were washed and dried (washed at a 60° C. for 30 minutes and dried at 80° C. for 45 minutes). This was repeated for 50 times, and practical performance of these mats were evaluated in regard to the following items.

(Items evaluated.)

1) Deviation and turn-up of the mats caused by the passers-by after they were washed and dried once (evaluated by naked eyes).

2) Deviation and turn-up of the mats caused by the passers-by after they were washed and dried 20 times (evaluated by naked eyes).

3) Deviation and turn-up of the mats when they were washed and dried 20 times, folded and stored, and were laid again (evaluated by naked eyes).

The testing of the items 1) and 2) is to evaluate the deformation of mats due to repeated use and the occurrence of deviation and turn-up due to degradation, and the testing of the item 3) is to evaluate practical performance of the dust-control goods from which the mat is unpacked and is used in an ordinary manner.

Table 1 shows the results of evaluation for the mats.

TABLE 1

| | Mat (A) (Example) (A) | Mat (B) (Comp. Ex.) (B) | Mat (C) (Comp. Ex.) (C) |
|---|---|---|---|
| (1) | movement of mat fabric 0 | movement of mat fabric 25 cm | movement of mat fabric 0 |
| | undulation at periphery 0 | undulation at periphery 0 | undulation at periphery 0 |
| (2) | movement of mat fabric 0 | movement of mat fabric 43 cm | movement of mat fabric 1 cm |
| | undulation at periphery 0 | undulation at periphery 5 waves | undulation at periphery 14 waves |
| (3) | movement of mat fabric 0 | movement of mat fabric 55 cm | movement of mat fabric 2 cm |
| | wrinkles none | wrinkles yes | wrinkles yes |

It will be understood from the results of Table 1 that the separate mat body (starting fabric) of Comparative Example (B) in which the backing layer is not blended with the magnetic powder and no magnetic junction system is used, exhibits large deviation and movement from the base, and the separate mat body (starting fabric) of Comparative Example (C) joined by the fastener system exhibits undulation at the periphery arousing a problem from the standpoint of safety in that pedestrians may stumble against the mat body (starting fabric).

In the test of the item (3) in which an ordinary packed good is unpacked and is laid, the mats (B) and (C) lacked fitness to the floor arousing a problem from the standpoint of safety.

With the mat (A) of the present invention, on the other hand, the mat body (starting fabric) is strongly adhered to the base sheet in all of the cases without arousing problems in regard to safety such as stumbling by the pedestrians and turn-up of the mat. Even right after the packed good is unpacked, the mat body favorably adheres to the base sheet and is favorably used without developing wrinkles.

We claim:

1. A separate mat for rent comprising a mat body having a base fabric, mat piles implanted on the base fabric and an elastomer backing applied to the back surface of the base fabric, and a base having a flat surface for supporting the mat body, wherein the backing of the mat body is formed of an elastomer coating blended with a magnetic powder, a frame-like thick elastomer backing sheet is applied to the periphery on the back surface of the mat body so as to protrude inwardly and outwardly beyond the edges of the base fabric, at least the flat surface of the base for supporting the mat body is formed of a magnet rubber sheet, and the edges along the periphery of the base are on the inside of the outer peripheral edges of the elastomer backing sheet.

2. A mat according to claim 1, wherein the backing elastomer of said mat body and the frame-like thick elastomer backing sheet are composed of a nitrile-butadiene rubber.

3. A mat according to claim 1, wherein both the backing of said mat body and the magnet rubber sheet of the base contain a high molecular plasticizer.

4. A mat according to claim 1, wherein the magnet rubber sheet of said base is composed of a nitrile-butadiene rubber.

5. A mat according to claim 1, wherein a fine rugged pattern is formed on the surface of said base on the side facing the ground.

6. A mat according to claim 1, wherein said mat body is molded by heating under the application of pressure.

* * * * *